US009027183B2

(12) United States Patent
Childs et al.

(10) Patent No.: US 9,027,183 B2
(45) Date of Patent: May 12, 2015

(54) PATIENT HANDLING DEVICE

(75) Inventors: William D. Childs, Plainwell, MI (US); Steven L. Birman, Otsego, MI (US); William V. Bleeker, Jr., Plainwell, MI (US); Paul M. Radgens, Vicksburg, MI (US); Dickson J. Brubaker, Climax, MI (US); Anish Paul, Portage, MI (US); Dennis B. Meyer, Portage, MI (US)

(73) Assignee: Stryker Corporation, Kalamazoo, MI (US)

( * ) Notice: Subject to any disclaimer, the term of this patent is extended or adjusted under 35 U.S.C. 154(b) by 579 days.

(21) Appl. No.: 13/343,352

(22) Filed: Jan. 4, 2012

(65) Prior Publication Data

US 2012/0102648 A1 May 3, 2012

Related U.S. Application Data

(62) Division of application No. 12/577,458, filed on Oct. 12, 2009.

(51) Int. Cl.
*A61G 1/02* (2006.01)
*A61G 1/048* (2006.01)
(Continued)

(52) U.S. Cl.
CPC ..... *A61G 1/0237* (2013.01); *A61G 7/012* (2013.01); *A61G 7/002* (2013.01); *A61G 1/048* (2013.01);
(Continued)

(58) Field of Classification Search
CPC ..... A61G 7/012; A61G 7/002; A61G 7/015; A61G 7/018; A61G 7/0507; A61G 2007/0509; A61G 2007/0524; A61G 1/0237; A61G 1/048; A61G 1/0225; A61G 1/0275; A61G 1/0287
USPC ..... 5/611, 617, 618, 614, 600
See application file for complete search history.

(56) References Cited

U.S. PATENT DOCUMENTS 4,164,355 A 8/1979 Eaton et al.
5,063,624 A 11/1991 Smith et al.
(Continued)

FOREIGN PATENT DOCUMENTS

JP 11-099182 4/1999
WO 99-08643 2/1999
WO 2011/046926 4/2011

OTHER PUBLICATIONS

PCT International Search Report and Written Opinion for corresponding PCT Application No. PCT/US2010/052310 dated Jun. 29, 2011.
(Continued)

*Primary Examiner* — Peter M Cuomo
*Assistant Examiner* — Brittany Wilson
(74) *Attorney, Agent, or Firm* — Warner Norcross & Judd LLP

(57) ABSTRACT

A patient handling device, such as a bed, stretcher, cot, or the like, includes a deck on which a patient may lie and which is surrounded by siderails. Control panels may be mounted on the siderails in a staggered fashion to improve the ease of accessing the control panels. A handle assembly may be included near the top of the Fowler section of the deck which allows a pair of handles to be squeezed independently for manual pivoting of the Fowler section. Squeezing one handle does not increase the force required to subsequently squeeze the other handle. The pivoting of the Fowler section may also be carried out automatically through an electrical actuator. The raising of the deck may be carried out through an electrical pump that pumps hydraulic fluid, and which may be activated near the top end of the stroke of a reciprocating pedal.

14 Claims, 12 Drawing Sheets

(51) Int. Cl.

| | |
|---|---|
| *A61G 7/012* | (2006.01) |
| *A61G 7/002* | (2006.01) |
| *A61G 7/015* | (2006.01) |
| *A61G 7/018* | (2006.01) |
| *A61G 7/05* | (2006.01) |

(52) U.S. Cl.

CPC ..... *A61G 7/015* (2013.01); *A61G 7/018* (2013.01); *A61G 2007/0509* (2013.01); *A61G 1/0225* (2013.01); *A61G 1/0275* (2013.01); *A61G 1/0287* (2013.01); *A61G 7/0507* (2013.01); *A61G 2007/0524* (2013.01)

(56) References Cited

U.S. PATENT DOCUMENTS

| | | | |
|---|---|---|---|
| 5,343,581 | A | 9/1994 | Bartley et al. |
| 5,996,151 | A | 12/1999 | Bartow et al. |
| 6,230,343 | B1 | 5/2001 | Buiskool et al. |
| 6,289,537 | B1 | 9/2001 | Hopper et al. |
| 6,772,850 | B1 | 8/2004 | Waters et al. |
| 6,820,294 | B2 | 11/2004 | Shiery et al. |
| 7,124,456 | B2 | 10/2006 | Palmatier et al. |
| 7,150,056 | B2 | 12/2006 | Lemire |
| 7,398,571 | B2 | 7/2008 | Souke et al. |
| 7,412,735 | B2 | 8/2008 | McDaniel et al. |
| 2007/0163045 | A1 | 7/2007 | Becker et al. |

OTHER PUBLICATIONS

Stryker Operations Manual for Electric Stretcher Model 1550-190-025F, Nov. 2005.

Stryker Maintenance Manual for Electric Stretcher Model 1550-490-027-G, Nov. 2005.

PATIENT HANDLING DEVICE

CROSS-REFERENCE TO RELATED APPLICATION

This application claims priority to, and is a divisional of U.S. patent application Ser. No. 12/577,458, filed Oct. 12, 2009, entitled PATIENT HANDLING DEVICE, which is incorporated by reference herein in its entirety.

BACKGROUND OF THE INVENTION

This invention relates generally to patient handling devices, such as, but not limited to, beds, stretchers, cots, and other ambulatory supports that are commonly found in hospital or care-giving institutions, and more particularly to improved patient handling devices.

Patient handling devices typically include a deck portion upon which a patient may sit or lie. The deck portion often is divided into different sections, some of which are pivotable about horizontal pivot axes, thereby allowing, for example, the patient to switch from lying completely flat to a position in which he or she is sitting up. The deck portion is attached to, or supported by, a frame which is, in turn, supported on a base. The base typically includes wheels that allow the device to be wheeled to different locations. One or more lifting mechanisms may be mounted between the base and the frame to allow the frame to be raised and lowered with respect to the base. A variety of different controls, such as buttons, handles, cranks, pedals, and other devices may be used to control and operate the various movements of the components of the patient handling device.

SUMMARY OF THE INVENTION

The present invention provides, in at least some embodiments, a patient handling device that includes one or more improved controls for manipulating one or more of the movable components on the patient handling device. Such controls may include a control for manually pivoting a head portion of the deck, a control for electrically pivoting a head portion of the deck, controls for lifting or lowering the deck vertically with respect to the base, controls for pivoting a knee gatch upward or downward, and other controls. Such controls overcome or alleviate one or more disadvantages of prior controls.

According to one embodiment, a patient handling device is provided that includes a base, a frame, a deck, an electric actuator, first and second siderails, and first and second control panels. The base includes a plurality of wheels that allow the patient handling device to be moved to different locations. The frame is supported by the base. The deck supports a patient and includes an upper section positioned to support a patient's torso and a seat section positioned adjacent to the upper section which is pivotable about a horizontal pivot axis between a horizontal and a raised orientation. The electric actuator pivots the upper section about the horizontal pivot axis. The first siderail is positioned along a first side of the deck, and the second siderail is positioned along a second side of the deck. The first control panel is supported on the first siderail at a location spaced a first distance from a head end of the device, and the second control panel is supported on the second siderail at a location spaced a second distance from the head end of the device, wherein the first distance is different from the second distance.

According to another embodiment, a patient handling device is provided that includes a base, a frame, a deck, an electric actuator, first and second handles, and a cable. The frame is supported on the base and the frame supports the deck. The deck supports a patient and includes an upper section that is pivotable about a horizontal pivot axis between a horizontal and a raised orientation. The electric actuator pivots the upper section about the horizontal pivot axis and is switchable between a first state in which rotation of the upper section about the pivot axis is permitted to occur electrically and a second state in which rotation of the upper section about the pivot axis is permitted to occur manually. The first and second handles are positioned adjacent first and second corners of the upper section of the deck. The cable is operatively coupled to both the first and second handles and the electric actuator in such a way so that squeezing of either or both of the first and second handles causes the electric actuator to switch from the first state to the second state, and squeezing the first handle does not increase the amount of force necessary to squeeze the second handle.

According to still another embodiment, a patient handling device is provided that includes a base, a frame, a plurality of lifts, a deck, and a pedal. The base supports the frame. The plurality of lifts are positioned between the frame and the base and raise and lower the frame relative to the base. The deck supports a patient and includes an upper section pivotable about a horizontal pivot axis between a horizontal and a raised orientation. The pedal is coupled to the base and movable between a raised position and a lowered position. The pedal activates an electric switch after the pedal has been moved downward from the raised position but prior to the pedal reaching the lowered position. The electric switch activates the plurality of lifts to raise the deck.

According to still another aspect, a patient handling device is provided that includes a base, a frame, a deck, an electric actuator, a biasing member and a control. The base supports the frame and the frame supports the deck. The deck supports a patient and includes an upper section pivotable about a horizontal pivot axis between a horizontal and a raised orientation. The electric actuator pivots the upper section about the horizontal pivot axis and is switchable between a first state in which rotation of the upper section about the pivot axis is permitted to occur electrically, and a second state in which rotation of the upper section about the pivot axis is permitted to occur manually. The control switches the electric actuator between the first and second states. The biasing member urges the upper section toward the raised position and, when the electric actuator is in the second state, the biasing member prevents the upper section from free-falling toward the horizontal position.

According to still other aspects, the biasing member may be a gas strut. The patient handling device may specifically be a stretcher. The first and second control panels may include controls for automatically pivoting the upper section of the deck about the horizontal pivot axis. The first and second controls may be positioned along the first and second siderails in staggered locations to thereby position one of the control panels for use when the upper section of the deck is raised, and position the other one of the control panels for use when the upper section is lowered. The cable may be a Bowden cable. The handles may be independently coupled to the cable such that squeezing one of the handles does not automatically cause the other handle to be squeezed. The interconnection of the handles to the cable may also be constructed such that the amount of force necessary to squeeze one of the handles after the other one has already been squeezed is less than the amount of force necessary to squeeze one of the handles when the other one has not already been squeezed. The various states of the electric actuator may be defined by a clutch inside the actuator being activated or not activated.

DETAILED DESCRIPTION OF THE EMBODIMENTS

Figure 1:
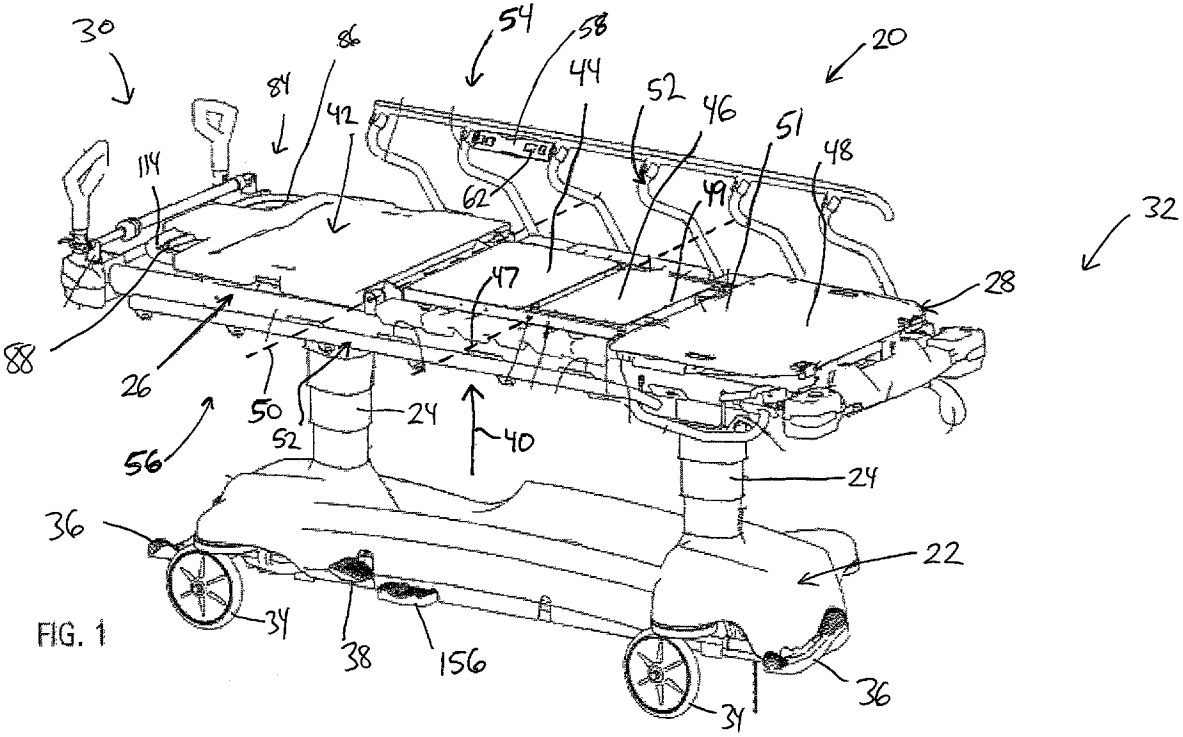
FIG. 1 is a perspective view of a patient handling device according to an illustrative embodiment.

A patient handling device 20 according to one embodiment is depicted in FIG. 1. Patient handling device 20, as illustrated in the accompanying figures, is a stretcher, but it will be understood that device 20 could also be implemented as a bed, a cot, a mobile surgical table, and a variety of other types of patient handling devices. Patient handling device 20 includes a base 22, a plurality of lifts 24 supported on the base 22, a frame 26 supported on the base 22 by way of the lifts 24, and a deck 28 supported on the frame 26. Deck 28 is adapted to support a mattress (not shown), or other suitable cushioning, upon which a patient may lie. Generally, the patient would position his or her head near a head end 30 of device 20 and his or her feet near a foot end 32 of device 20.

Base 22 includes a plurality of wheels 34 (FIG. 1) which enable device 20 to be wheeled to different locations. Wheels 34 may be castered wheels enabling them to be freely rotated in different directions, or they may be other types of wheels. Base 22 may include one or more brake pedals 36 that selectively lock and unlock wheels 34, thereby selectively preventing or allowing wheels 34 to rotate. Base 22 also includes, in the illustrated embodiment, a lift pedal 38 that may be pushed by a user's foot to activate lifts 24 and thereby lift frame 26 and deck 28 vertically in a direction indicated by arrow 40 in FIG. 1. The manner in which foot pedal 38 accomplishes the vertical movement of frame 26 and deck 28 will be described in greater detail below.

Deck 28, in the illustrated embodiment, is divided into four sections: an upper or head section 42 (also referred to as a Fowler section), a seat section 44, a thigh section 46, and a foot section 48. In some embodiments, deck 28 may be divided into fewer or greater numbers of sections. In the illustrated embodiment, upper deck section 42 is pivotable about a horizontal pivot axis 50 between a lowered orientation (such as illustrated in FIG. 1) and a raised orientation (not shown). In the lowered orientation, a patient's head and torso are able to lie generally flat and parallel to the ground. In the raised orientation, upper section 42 helps support a patient's back so that he or she may sit up while still resting on deck 28. The pivoting of upper section 42 about horizontal pivot axis 50 may be carried out both manually and electrically, as will be discussed in greater detail below.

Figure 2:
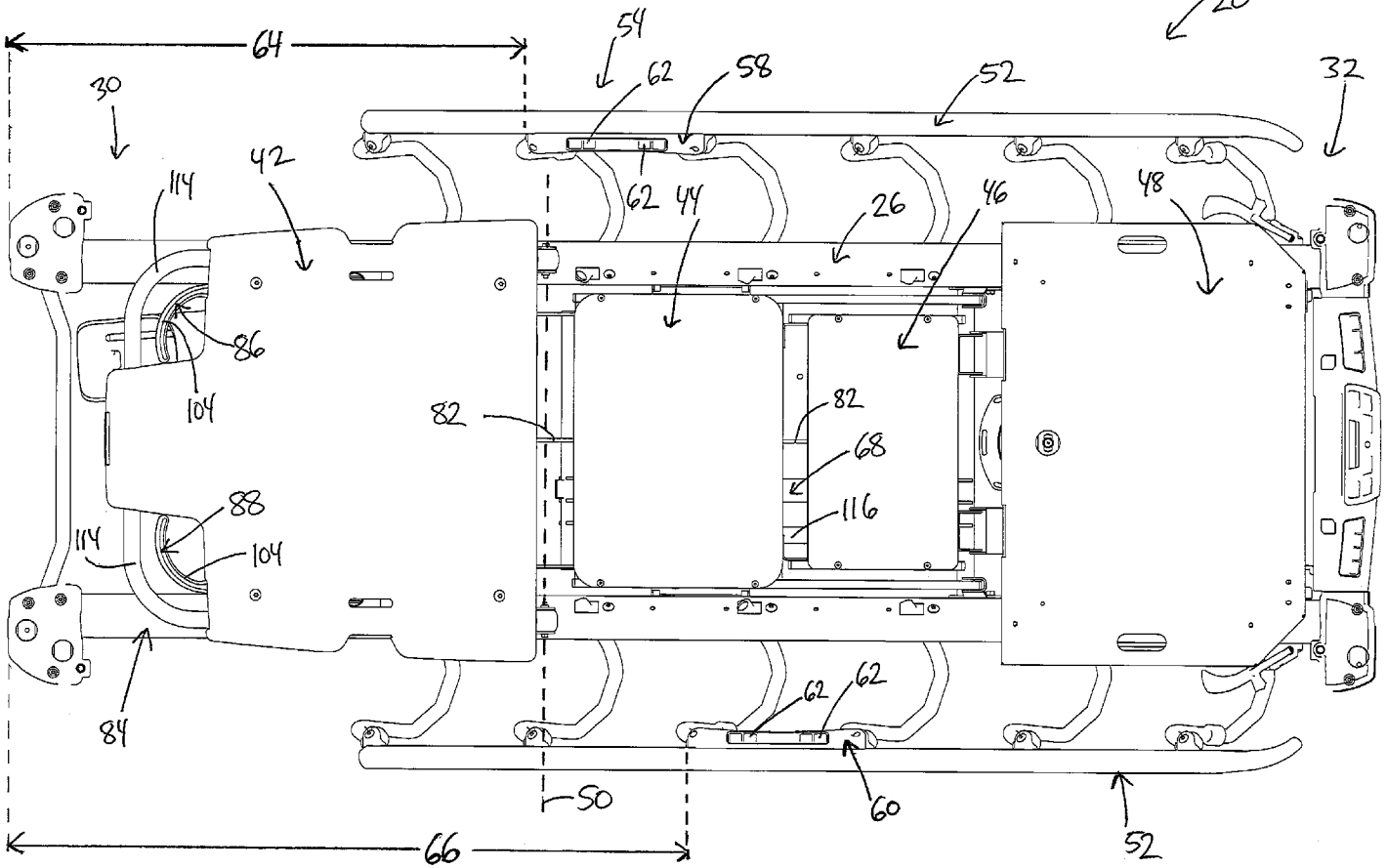
FIG. 2 is a plan view of a frame, deck, and siderails of the patient handling device of FIG. 1.

A pair of siderails 52 are positioned on either side of deck 28 and help prevent a patient from rolling, or otherwise falling, off of deck 28. Siderails 52 are moveable between a raised orientation and a lowered orientation. In the embodiment illustrated in FIG. 1, a siderail 52 on a first side 54 of patient handling device 20 is shown in the raised position while another siderail 52 on a second, opposite side 56 is shown in the lowered position. A first control panel 58 is positioned on the first siderail 52 while a second control panel 60 is positioned on the second siderail 52 on the opposite side (FIG. 2). Control panels 58 and 60 include one or more controls 62 positioned thereon for controlling one or more aspects of patient handling device 20. The controls 62 may take on a variety of different forms, such as, but not limited to, buttons, touchscreens, knobs, levers, switches, and the like. At least one of the controls 62 may be configured to control the automatic pivoting of head section 42 about horizontal pivot axis 50. That is, a patient or caregiver may press, or otherwise manipulate, one of controls 62 to cause an electrical actuator to pivot head section 42 about axis 50. Such automatic pivoting may be in either direction.

Control panels 58 and 60 may include additional or alternative controls 62 for controlling other aspects of patient handling device 20. Such other controls may include controls for moving lifts 24 up and down (either simultaneously or independently), controls for automatically pivoting one or more of the other deck sections 44, 46, and/or 48 about various horizontal pivot axes, and any other controls for which it is desirable for a patient positioned on deck 28 to have ready access to. The pivoting movement of the other deck sections 44, 46, and/or 48 may include the pivoting of a knee gatch. That is, thigh section 46 may be pivoted about a pivot axis 47 such that a foot end 49 of thigh section 46 is lifted or lowered vertically (FIG. 1). Because of the mechanical connection of the foot end 49 of thigh section 46 to a head end 51 of foot section 48, the up and down movement of foot end 49 of thigh section 46 will cause a corresponding upward and downward movement of head end 51 of foot section 48. The coordinated movement of the thigh section 46 and foot section 48 has the effect of raising or lowering the knees of a patient lying on deck 28.

As can be seen more clearly in FIG. 2, control panels 58 and 60 are positioned in a staggered fashion along sides 54 and 56 of device 20. That is, control panel 58 is positioned a first distance 64 from head end 30 of device 20, and control panel 60 is positioned a second distance 66 from head end 30 of device 20. First distance 64 is less than second distance 66. The difference between first and second distances 64 and 66 is chosen such that a patient positioned on device 20 will have easy access to at least one of control panels 58 and 60 regardless of the particular orientation of head section 42 about pivot axis 50. That is, control panels 58 and 60 are positioned at different distances 64 and 66 because the ease at which a patient can reach a particular location with his or her hands will differ depending upon whether they are lying completely flat or are completely sitting up, or are positioned in an orientation somewhere in between.

In the embodiment illustrated in FIG. 2, first control panel 58 is positioned to be easily accessible to a patient when the patient is lying completely flat on deck 28, or nearly completely flat on deck 28. Thus, when head section 42 is pivoted to the lowered orientation, or generally near the horizontal orientation, first control panel 58 will be within reach of the patient's hands without requiring the patient to sit up, or partially sit up, to access control panel 58. On the other hand, second control panel 60 will be positioned further away from the patient's hands when he or she is lying flat, and may not be as easily accessible to the patient. However, when head section 42 is pivoted upwardly toward the raised orientation, this pivoting will bring the patient's hands closer to second control panel 60. Therefore, second control panel 60 may be more easily accessible to the patient while he or she is sitting up. Indeed, while the patient is sitting up, first control panel 58 may be positioned too close to the patient's hips to be easily or comfortably used. While the precise positioning of first and second control panels 58 and 60 can be varied widely, second control panel 60 may be positioned, in one embodiment, such that it lies approximately between a patient's hips and knees when the patient is sitting up. First control panel 58 may be positioned such that it is nearer to head end 30 than the patient's hips when lying completely flat. Other locations for first and second control panels 58 and 60 may also be used such that at least one of them can be easily accessed by a patient in both the supine and sitting up positions.

Figure 3:
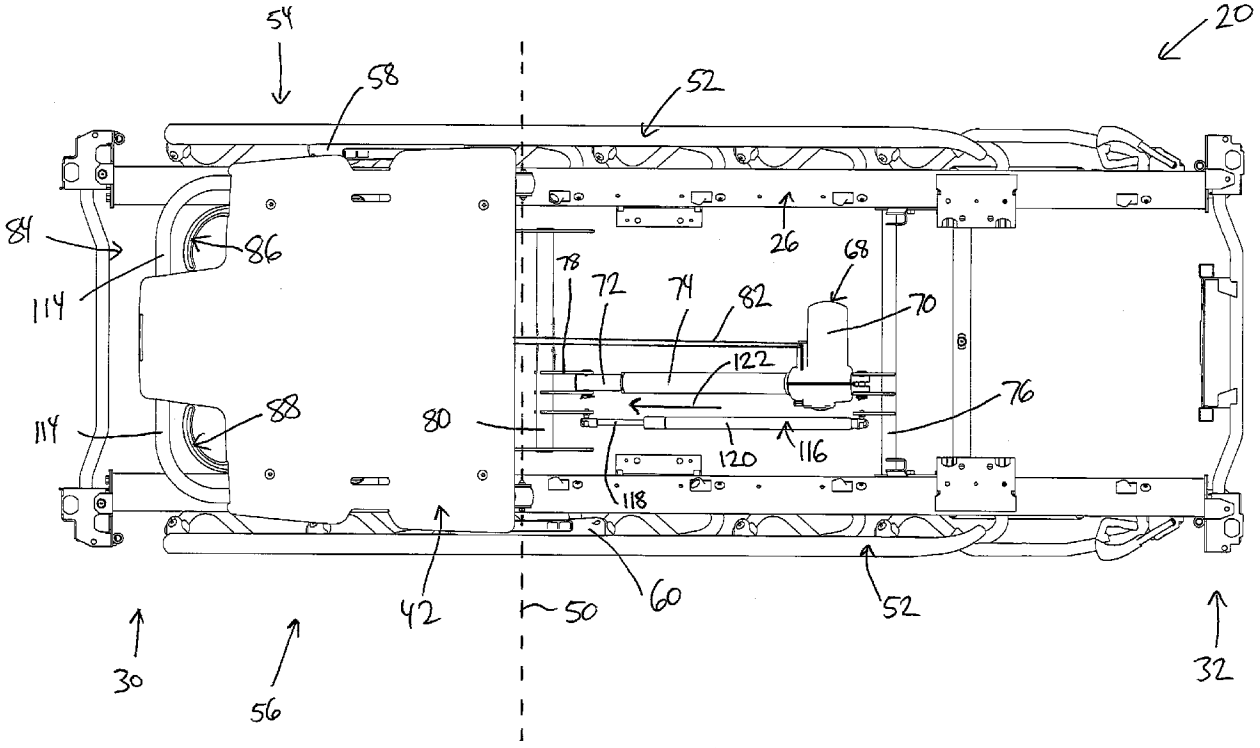
FIG. 3 is a plan view similar to FIG. 2 shown with several components of the deck removed to illustrate the underlying structures.

The pivoting of head section 42 about pivot axis 50 may be carried out on patient device 20 either manually or electrically. The manner in which the electrical pivoting of head section 42 is carried out is illustrated in greater detail in FIGS. 3 and 4. As shown therein, patient handling device 20 includes an electrical actuator 68 positioned generally underneath deck 28. Electrical actuator 68 includes a motor 70 (FIG. 3) that selectively drives an actuator rod 72 either into, or out of, a surrounding cylinder 74. The movement of actuator rod 72 in the direction indicated by arrow 122 causes the effective length of actuator 68 to change. Because electrical actuator 68 is coupled at its head end to a stationary cross member 76, changes in the effective length of electrical actuator 68 will cause actuator rod 72 to exert a force against a bracket 78 attached to an exterior end of actuator rod 72. Bracket 72 is connected to a cross member 80 of head section 42. The force exerted by actuator 68 on bracket 72 will therefore be transferred to cross member 80 and head section 42. Due to the position of bracket 78 relative to pivot axis 50, the force exerted by bracket 78 against cross member 80 will result in a torque being applied to head section 42, thereby urging head section 42 to rotate about axis 50. The direction of rotation will, of course, depend upon whether actuator 68 is expanding (in which case head section 42 pivots upward) or retracting (in which case head section 42 pivots downward).

Electrical actuator 68 may receive its power from one or more batteries positioned on patient handling device 20, or it may receive its power from a wall outlet into which an electrical cord on patient handling device 20 may be plugged, or both. The provision of both an electrical cord and batteries on patient handling device 20 allows it to maintain power while being transported to different locations, including locations where no external source of power may be available, while also allowing device 20 to utilize external power (and thereby conserve battery power) when it is stationary and within the vicinity of such a source of external power (such as a wall outlet).

Electrical actuator 68 may be a conventional linear actuator that converts the rotary motion of motor 70 into linear displacement of actuator rod 72. Electrical actuator 68 is configured to be switchable between at least two different states. In a first state, electrical actuator 68 effectively prevents any pivoting motion of head section 42 unless motor 70 is running. In a second state, electrical actuator 68 allows free pivoting of head section 42 about pivot axis 50. In the embodiment illustrated, electrical actuator 68 switches between the first and second states by way of an internal clutch (not shown), or clutch-type mechanism. Such clutches and clutch-type mechanisms are known in the art and their internal design need not be described further. In the first state, the clutch is engaged and the rotary motion of motor 70, if running, is transferred by the clutch to actuator rod 72, thereby causing actuator rod 72 to move linearly. If the motor is not running while actuator 68 is in the first state, the engaged clutch substantially prevents actuator rod 72 from moving linearly. The engaged clutch therefore prevents head section 42 from falling downward to its lowered orientation and maintains head section 42 in its current orientation. When the clutch is disengaged and actuator 68 is in the second state, actuator 68 provides no significant resistance to the pivoting movement of head section 42 about axis 50. When in the second state, therefore, actuator 68 allows for the manual pivoting of head section 42, as will be described more below.

As can be seen more clearly in any of FIGS. 4-7, a cable 82 connects electrical actuator 68 to a handle assembly 84 positioned generally near a head end of head section 42. Handle assembly 84 includes a first handle 86 and a second handle 88. Cable 82 may be a Bowden cable, or other suitable cable, that allows the mechanical motion of either of handles 86 and 88 to be transferred to electrical actuator 68. As is known to those skilled in the art, such a cable includes an outer sleeve that surround an internal cable. An adjustment screw 83 may be positioned adjacent handle assembly 84 to allow for adjustments of the internal cable relative to the outer sleeve. Cable 82 is coupled to electrical actuator 68 at an interface to the clutch, or clutch-like mechanism, of actuator 68. As a result, and as will be described in more detail below, whenever either or both of handles 86 and 88 are squeezed, cable 82 causes the clutch, or clutch-type mechanism, inside electrical actuator 68 to become disengaged, thereby switching actuator 68 to the second state in which relatively free pivoting of head section 42 about axis 50 can take place.

Figure 4:
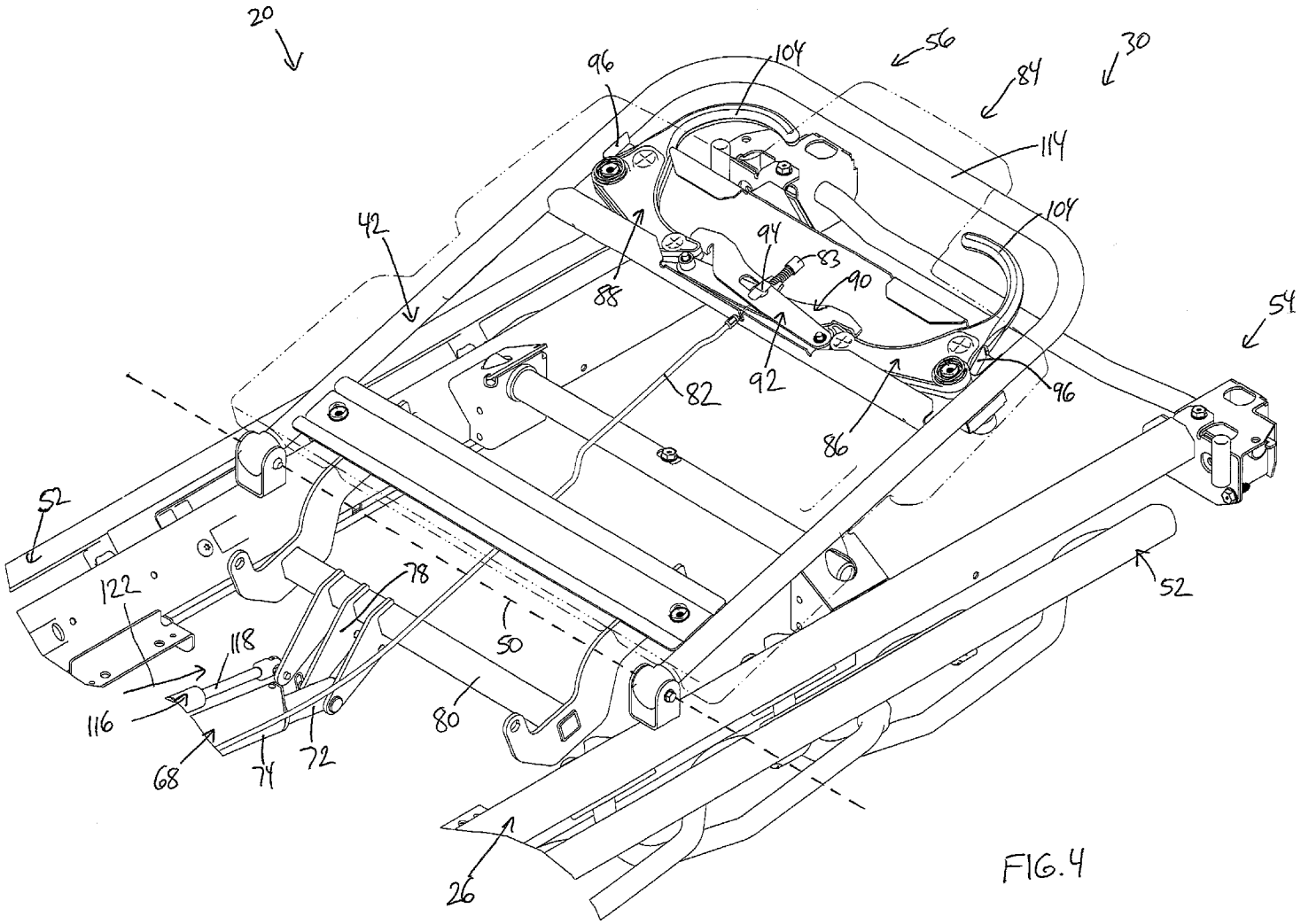
FIG. 4 is a partial, perspective view of an upper section of the deck showing a pair of handles in an unsqueezed position.
Figure 7:
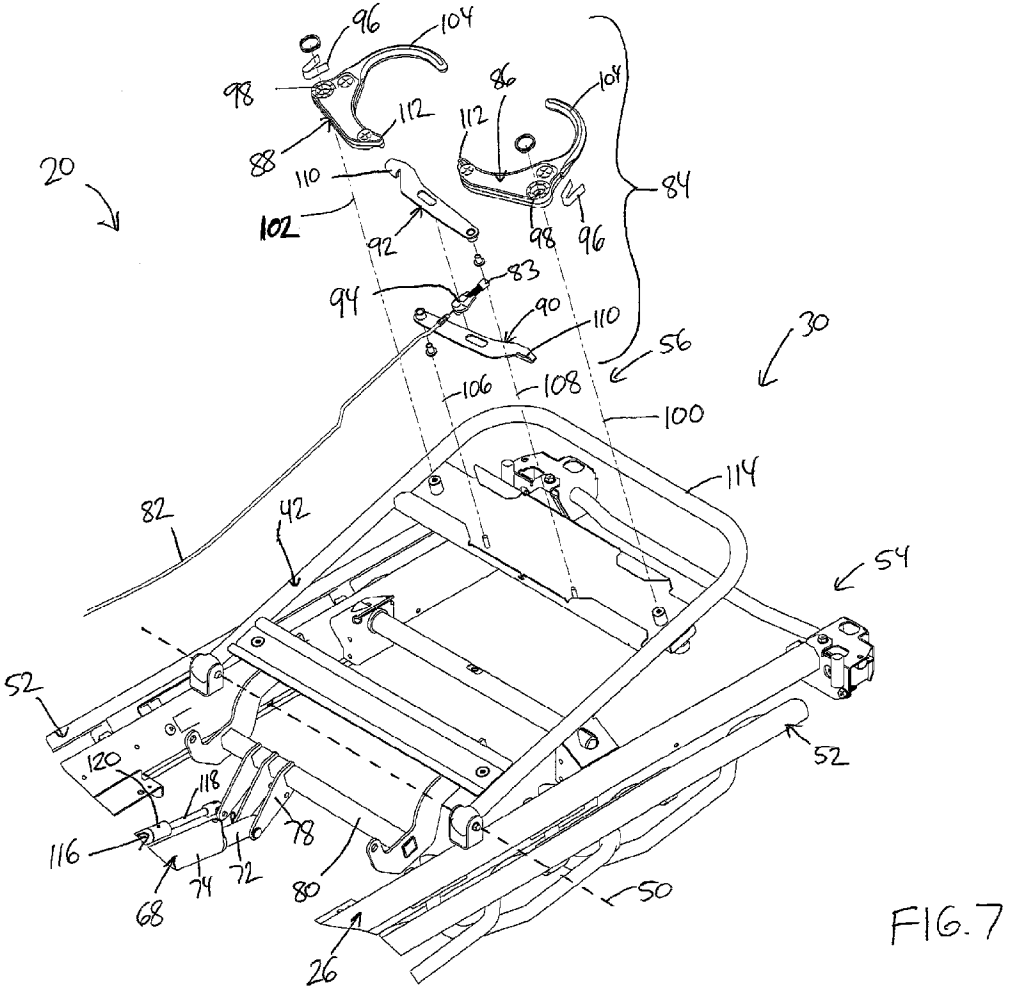
FIG. 7 is a partial, exploded, perspective view of the components of FIG. 4.

In addition to first and second handles 86 and 88, handle assembly 84 includes a first lever 90, a second lever 92, a cable connector 94, a pair of return springs 96, and various bushings to allow the handles 86 and 88 and levers 90 and 92 to rotate (FIG. 7). Each handle 86 and 88 includes an aperture 98 into which a bushing is inserted in order to allow handles 86 and 88 to pivot about pivot axes 100 and 102, respectively. Handles 86 and 88 also each include a gripping portion 104 that is designed to be grasped or squeezed by a person. Handles 86 and 88 are therefore pivotable between unsqueezed and squeezed orientations. FIG. 4 illustrates both handles 86 and 88 in the unsqueezed orientations. Each return spring 96 exerts a force on its adjacent handle that urges handles 86 and 88 toward the unsqueezed orientation. This return force may be easily overcome by a person squeezing on handles 86 or 88, but it is sufficient to return handles 86 or 88 to their unsqueezed orientations when a person ceases to squeeze the respective handle.

Each lever 90 and 92 includes an aperture defined at one end through which a bushing may be inserted to allow levers 90 and 92 to rotate about pivot axes 106 and 108, respectively (FIG. 7). Each lever 90 is also attached in its middle region to cable connector 94. A flange 110 is defined on each lever 90 and 92 at an end opposite the apertures defined therein. Each flange 110 is positioned to selectively abut against a corresponding lip 112 defined on each handle 86 and 88. When a caregiver grasps first handle 86 and squeezes it, first handle 86 pivots about first pivot axis 100. This pivoting motion causes lip 112 to push against flange 110 on first lever 90, thereby causing first lever 90 to pivot about first pivot axis 106. The pivoting of first lever 90 forces cable connector 94 to pull an internal cable within cable 82 toward head end 30. The movement of this internal cable causes actuator 68 to switch from the first state to the second state. A caregiver who wishes to manually pivot head section 42 about pivot axis 50 may therefore squeeze first handle 86, which will disengage the clutch inside of actuator 68, thereby allowing head section 42 to pivot in response to the caregiver's manual manipulation of head section 42.

In a similar manner, the squeezing of second handle 88 will cause handle 88 to pivot about second pivot axis 102. This pivoting will force lip 112 of second handle 88 against flange 110 of second lever 92, thereby causing second lever 92 to pivot about second pivot axis 108. Because second lever 92 is also connected to cable connector 94, the pivoting motion of second lever 92 will also pull the internal cable within cable 82 toward head end 30 of patient handling device 20. This pulling of the internal cable will disengage the internal clutch inside electric actuator 68, thereby allowing manual rotation of head section 42 about pivot axis 50.

Figure 5:
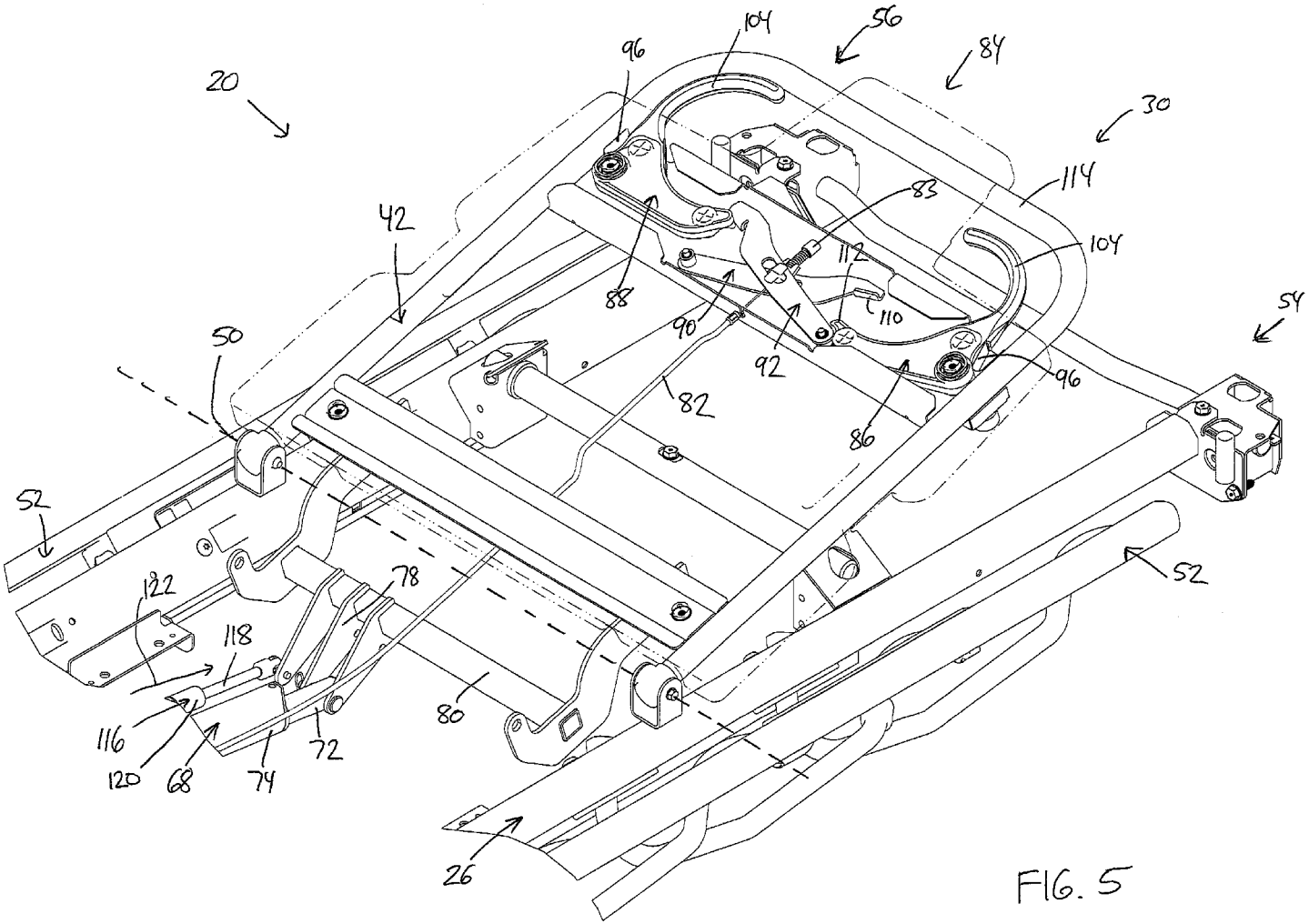
FIG. 5. is a partial, perspective view similar to FIG. 4 showing one of the handles in a squeezed position.
Figure 6:
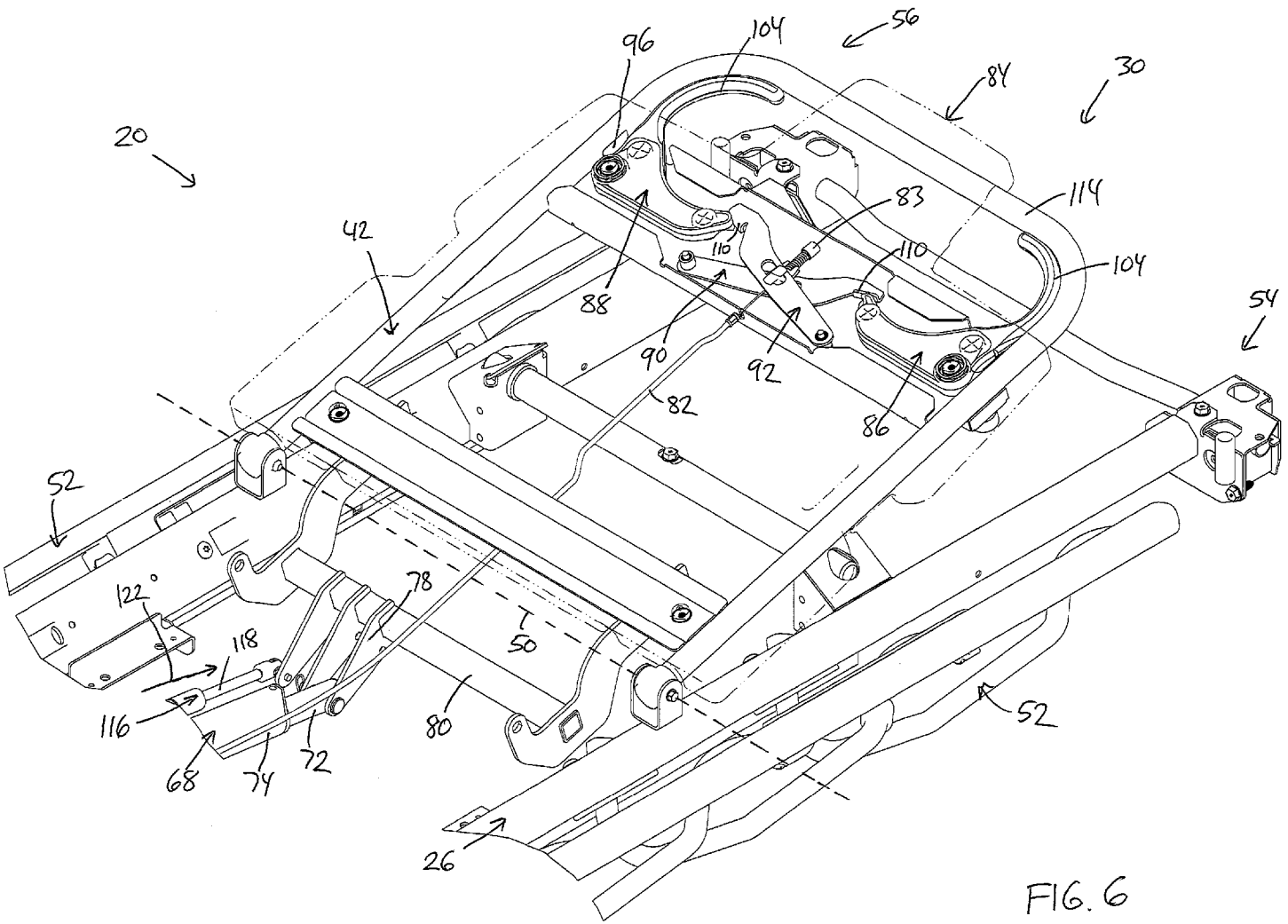
FIG. 6 is a partial, perspective view similar to FIG. 4 showing both of the handles in a squeezed position.

As can be seen in FIG. 5, when second handle 88 has been squeezed, the pivoting motion of second lever 92 will, due to the common connection to cable connector 94, cause first lever 90 to pivot. To the extent first handle 86 is not squeezed, the pivoting of first lever 90 will cause flange 110 of first lever 90 to disengage from lip 112 of first handle 86. Therefore, if a caregiver squeezes second handle 88 and continues to squeeze it, any subsequent squeezing of first handle 86 (while second handle 88 is still squeezed) will require substantially less force than if first handle 86 were squeezed while second handle 88 was unsqueezed. This is due to the fact that when second handle 88 is squeezed, flange 110 of first lever 90 no longer resists the rotational movement of first handle 86 because flange 110 is out of contact with lip 112 of first handle 86. The resistance a caregiver squeezing first handle 86 experiences is therefore primarily due only to that of return spring 96. As a result, squeezing first handle 86 after second handle 88 has been squeezed requires approximately the same, or less, force than squeezing first handle 86 by itself. The opposite is also true; namely, squeezing second handle 88 while first handle 86 has already been squeezed will require approximately the same, or less force, than when second handle 88 is squeezed by itself. Thus, the initial squeezing of either handle will not cause any substantial increase in the the force necessary to subsequently squeeze the other handle so long as the initial handle remains squeezed. In at least one embodiment, the force required to squeeze a second handle after a first one has already been squeezed will be within about a half pound (plus or minus) of the force otherwise required to squeeze the second handle when the first handle has not been squeezed. Other ranges of force may also be used.

By requiring substantially the same, or less, force to squeeze one of the handles after the other handle is squeezed, at least one disadvantage of some prior art stretcher handles is overcome. In some prior art stretchers, the initial squeezing of a handle will substantially increase the amount of force required to squeeze the other handle. An example of such a prior art patient handling device is found in commonly-assigned U.S. Pat. No. 7,124,456 entitled Articulated Support Surface for a Stretcher or Gurney. In such prior art patient handling devices, the caregiver is penalized with having to exert multiple pounds of additional force when squeezing a handle after the other handle has already been squeezed. The penalty may be as much as twice the force that would otherwise be needed if only a single handle were squeezed, or more.

The construction of handle assembly 84 in the patient handling device 20 disclosed herein overcomes this disadvantage. If two caregivers are present, one on each side of patient handling device 20, the second caregiver to squeeze a handle 86 or 88 is not penalized with having to exert a greater force than the first caregiver. Similarly, if a single caregiver positions himself or herself behind patient handling device 20 and squeezes both handles 86 and 88 together in order to manually adjust head section 42, the single caregiver is not penalized with having to exert additional force if he or she does not squeeze both handles 86 and 88 together precisely simultaneously. Handle assembly 84 therefore either reduces, or renders substantially equal, the forces necessary to squeeze handles 86 or 88 after the other one has been squeezed.

It should be noted that handles 86 and 88 are independent. That is, the squeezing of handle 86 does not cause handle 88 to move, nor does the squeezing of handle 88 cause handle 86 to move. This independence helps alleviate the possibility of pinching that sometimes exists with handles that are not independent. For example, if a first caregiver is grasping a perimeter bar 114 of head section 42 adjacent first handle 86 in order to assist in the manual pivoting of head section 42 and the second caregiver proceeds to squeeze the second handle 88, the first caregiver's fingers could get pinched between first handle 86 and perimeter bar 114. By designing handles 86 and 88 independently, a caregiver's handle squeezing on one side of device 20 will not affect the handle movement on the other side of device 20.

As can be seen in FIGS. 3-7, patient handling device 20 also includes a gas strut 116 connected at one end to head section 42 and at the other end to cross member 76. Gas strut 116 includes an inner plunger 118 and an outer cylinder 120. Gas strut 116, which may be a conventional gas strut, is configured such that it always is exerting an expansive force—that is, gas strut 116 is always exerting a biasing force that tends to push plunger 118 out of outer cylinder 120 in direction 122 (FIG. 4-7). This biasing force acts against head section 42 and tends to bias head section 42 towards it upright position. So long as the clutch of actuator 68 remains engaged, however, head section 42 will not pivot in response to the biasing force of gas strut 116, but will instead either remain stationary (if motor 70 is not running), or will move as dictated by actuator 68 (when motor 70 is running).

When a person squeezes one or both of handles 86 and 88, thereby disengaging the clutch of actuator 68, the biasing force of gas strut 116 will no longer be overcome by the internal resistance of the engaged clutch. Instead, in the absence of a patient or other person pushing head section 42 toward its lowered orientation, head section 42 will pivot upward in response to the biasing force of gas strut 116. The amount of biasing force exerted by gas strut 116 may vary, but is generally chosen so as to prevent head section 42 from free-falling downward and potentially slamming into the flat orientation when a patient is positioned on deck 28 and one or both of the handles 86, 88 is squeezed. That is, gas strut 116 exerts a biasing force that will resist the downward force of a patient's weight on head section 42 in a manner that causes head section 42 to descend smoothly. Thus, the weight of a typical patient will be sufficient to overcome the biasing force of strut 116, but not by such a large factor so as to cause head section 42 to pivot downwardly at an excessive speed or to require a caregiver to exert large forces when manually lifting head section 42. Indeed, should a caregiver choose to pivot head section 42 manually, rather than through the use of electric actuator 68, the biasing force of strut 116 will assist the caregiver in doing so because the strut 116 will reduce the amount of lifting force that a caregiver would otherwise have to manually apply to head section 42 to raise it up when a patient is positioned on deck 28.

Handles 86 and 88 gives patient handling device 20 a backup method for changing the orientation of head section 42 in cases where electrical power is no longer available to actuator 68 (such as with drained batteries), or when electrical actuator 68 otherwise may be inoperative. Handles 86 and 88 also give patient handling device 20 a method for quickly moving the patient's torso to a flat orientation should emergency cardiopulmonary resuscitation (CPR) become necessary. Rather than waiting for actuator 68 to pivot head section 42 down to a flat orientation, a caregiver can squeeze either of handles 86 or 88 and manually swing head section 42 down to a flat orientation at a greater rate of speed, thereby allowing the commencement of CPR to take place sooner.

As was noted previously, patient handling device 20 includes a pair of lifts 24 that are adapted to raise and lower frame 26 with respect to base 22. Lifts 24 are activated by way of lift pedal 38 coupled to base 22 (FIGS. 1 and 8-10). While only one such lift pedal 38 is depicted in FIGS. 1 and 8-10, a second lift pedal may be positioned on an opposite side of patient handling device so that a caregiver can access lift pedal 38 from either side of device 20. Indeed, in some embodiments, a lift pedal 38 may also be placed at a head end and/or a foot end of base 22 to allow lifting to be accomplished from either end of device 20, as well as from either side. Regardless of the number of lift pedals 38, their operation will now be described below with reference to FIGS. 8-11.

Figure 8:
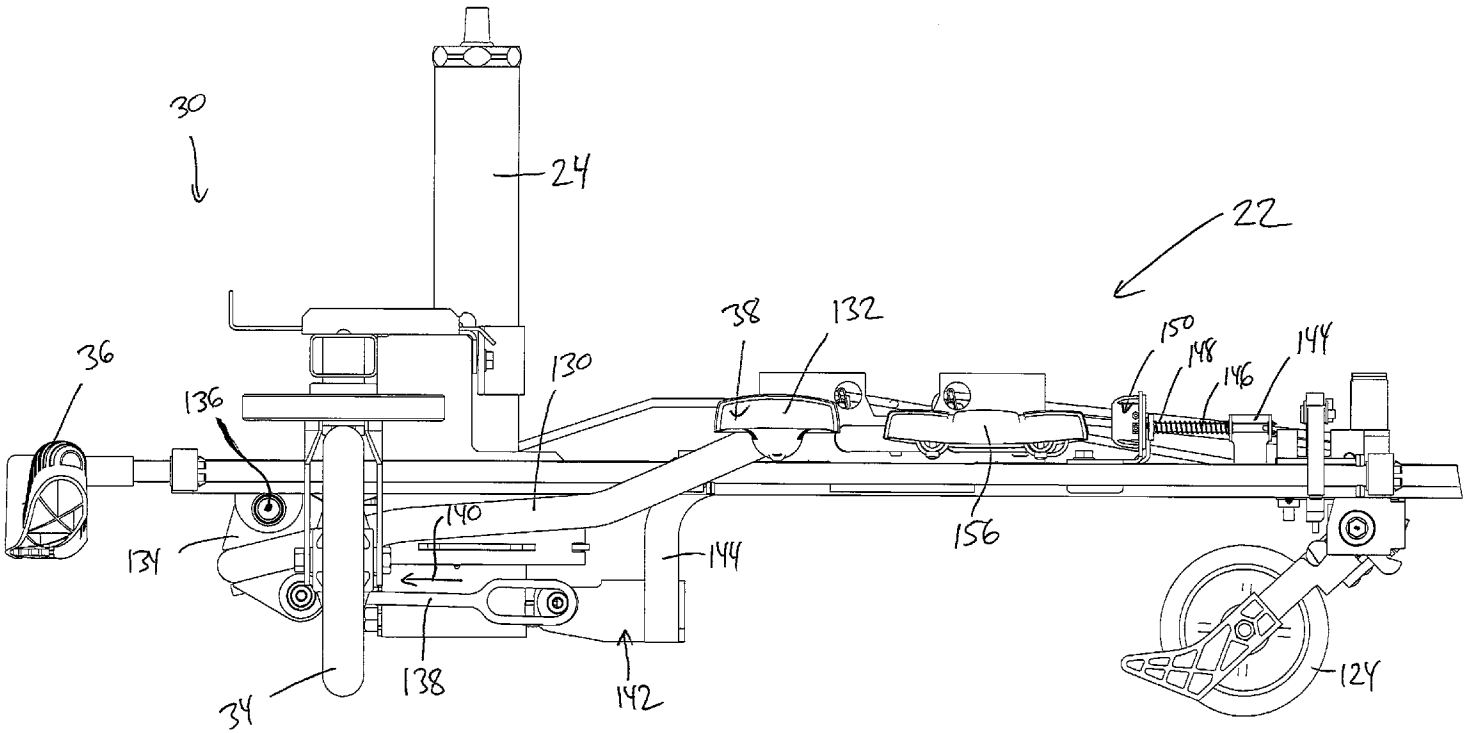
FIG. 8 is a partial, side, elevational view of a base of the patient handling device, including a pedal shown in a raised position.

In the illustrated embodiment, lift pedals 38 may be used for either manual or automated lifting of frame 26, or both. More specifically, lifts 24 operate by way of a hydraulic system that may be manually pumped with lift pedal 38, or electrically pumped by way of an electric pump that is switched on by lift pedal 38. The manner in which lift pedal 38 manually and/or electrically activates lifts 24 can best be understood with reference to FIGS. 8-11. FIG. 8 illustrates a portion of the underlying structure of base 22. Lift pedal 38 includes a crank arm 130 having a foot pad 132 attached at one end. The opposite end of crank arm 130 is coupled to a pivot joint 134. Pivot joint 134 is pivotable about a horizontal axis 136 that extends into and out of the plane defined by the pages of FIGS. 8-10. An end of pivot joint 134 opposite to pivot axis 136 is coupled to an arm 138. The pivoting of pivot joint 134, which is accomplished by a user pressing down on foot pad 132 of lift pedal 38, causes arm 138 to move in the direction indicated by arrow 140.

Arm 138 is connected at its end opposite pivot joint 134 to a pump connecting rod 142. The translating motion of arm 138 due to the pivoting of pivot joint 134 is transferred by arm 138 to pump connecting rod 142. Pump connecting rod 142 will thus move in direction 140 when lift pedal 38 is depressed. Pump connecting rod 142 includes a vertical portion 144 and a horizontal portion that is obscured from view in FIGS. 8-10. The horizontal portion extends toward a center wheel 124. A vertical extension 144 is coupled to the horizontal section and reciprocates with pump connecting rod 142 when pedal 38 is pressed. Vertical extension 144 includes a central aperture that envelopes a horizontal pin 146. Vertical extension 144 thus travels along horizontal pin 146 when pedal 38 is pressed. A spring 148 surrounds horizontal pin 146 and biases vertical extension 144 away from a switch 150. Switch 150 is a snap action switch that senses when pedal 38 has moved from the raised position illustrated in FIG. 8 to the intermediate orientation depicted in FIG. 9. As will be discussed in greater detail below, switch 150 is in electrical communication with an electrical pump 154 (FIG. 11) that electrically pumps fluid to lifts 24, thereby raising frame 26.

Switch 150 is configured such that only a small amount of downward movement of lift pedal 38 from the raised orientation shown in FIG. 8 is necessary before electrical pump 154 is activated. This has the effect of causing the automatic lifting of frame 26 to start prior to lift pedal 38 reaching the bottom of its down stroke. The automatic raising of frame 26 will therefore occur almost immediately after lift pedal 38 is pressed. This overcomes the disadvantage of some prior art lift pedals where the switch was not activated, and thus the electric pump as well, until the pedal reached the complete bottom of its down stroke. In such prior art pedals, the automatic lifting of the deck only occurred during those moments in time when the pedal was in its lowermost position (the bottom of the down stroke). If a caregiver was unaware that the patient handling device included an automatic lifting feature, he or she might continue to manually pump the pedal to raise the frame, remaining unaware of the automatic lifting feature because the amount of time the pedal was in its lowermost position was so fleeting that any automatic lifting triggered thereby was not noticeable. With the pedal arrangement of patient handling device 20, however, the automatic lifting is apparent to the caregiver because it is activated near the raised position of lift pedal 38, not near its bottom position.

As was mentioned above, the pressing downward of lift pedal 38 also causes a manual pumping of hydraulic fluid into lifts 24, thereby effecting an upward movement of frame 26 every time pedal 38 is depressed. The manner in which the reciprocating movement of pump connecting rod 142 and/or arm 138 can be transmitted to the hydraulic lifts 24 can take on a wide variety of different forms, as would be known to one of ordinary skill in the art. One such manner is disclosed in commonly assigned U.S. Pat. No. 6,820,294 entitled Linkage for Lift/Lowering For a Patient Supporting Platform, the complete disclosure of which is incorporated herein by reference. Other manners may also be used.

The manual pumping of hydraulic fluid effectuated by the downward movement of lift pedal 38 enables frame 26 to be raised even in the absence of electrical power. Frame 26 may therefore be raised even if a power outage occurs and/or one or more batteries on board patient handling device 20 become drained or otherwise inoperative.

Figure 9:
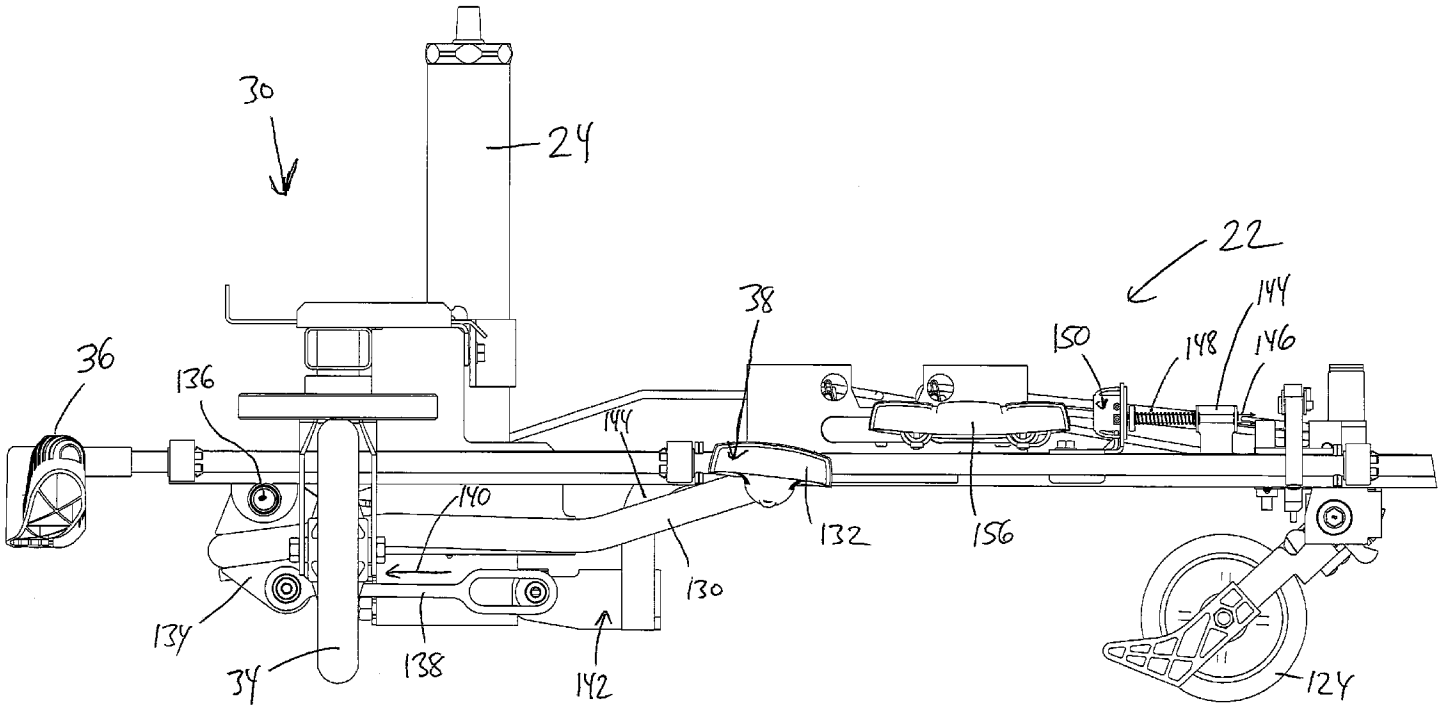
FIG. 9 is a partial, side, elevational view similar to FIG. 8 showing the pedal in an intermediate position.
Figure 10:
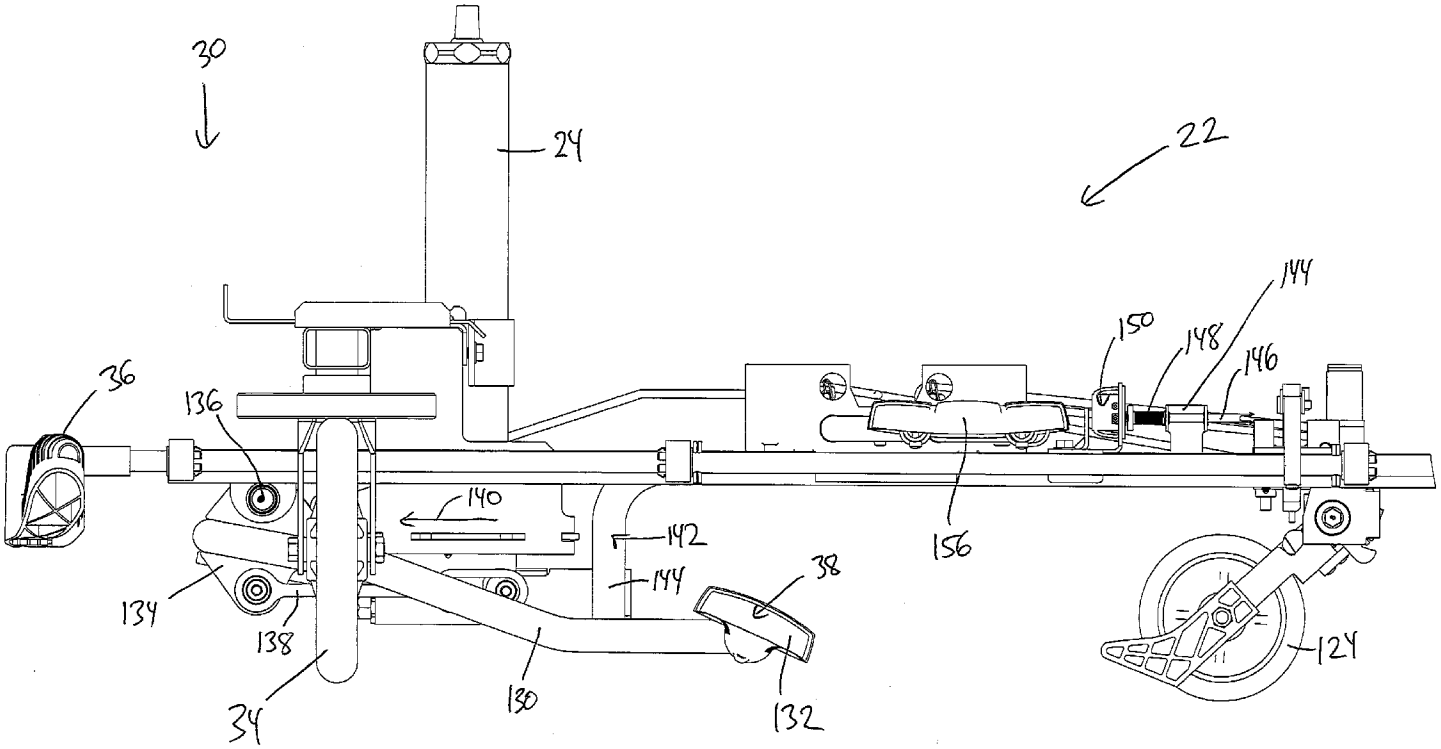
FIG. 10 is a partial, side, elevational view similar to FIG. 9 showing the pedal in a lowered position.

The stopping of electrical pump 154 occurs when lift pedal 38 is returned back to its raised position (FIG. 8). This stopping occurs because, when pedal 38 is in its raised position, switch 150 is no longer activated, thereby cutting off power to electrical pump 154. The lowering of frame 26 takes place by a user pushing on lowering pedal 156 (FIGS. 8-10). The pressing of lowering pedal 156 allows hydraulic fluid to empty out of the lifts 24, thereby allowing frame 26 to be smoothly lowered. This lowering takes place without the assistance of any electrical motors or actuators, thereby enabling it to be performed even in the absence of electrical power. The amount of lowering is controlled by the length of time lowering pedal 156 remains pressed—as soon as pedal 156 is released, the lowering stops.

Figure 11:
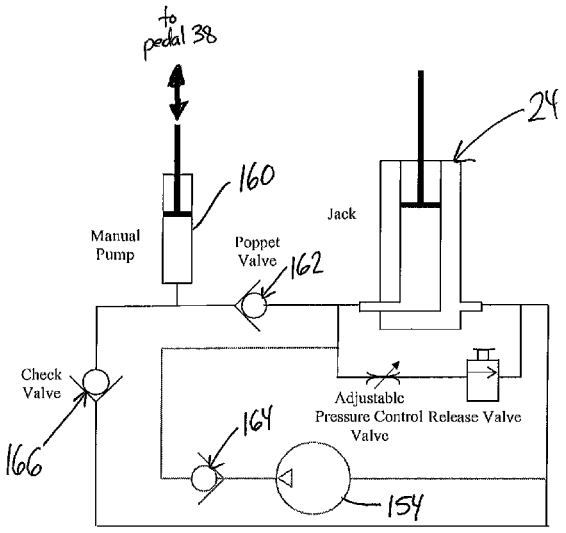
FIG. 11 is a diagram of a hydraulic control circuit that may be used to control the hydraulic lifting of the frame and deck relative to the base.

FIG. 11 illustrates a hydraulic circuit that may be utilized in conjunction with lift pedal 38 in order to carry out the lifting functions described herein. The pushing of lifting pedal 38 activates a manual pump 160, which opens a first poppet valve 162, thereby allowing hydraulic fluid to be delivered to lifts 24 such that lifts 24 will raise frame 26 upward. The pushing of lifting pedal 38 also activates, through switch 150, electrical pump 154. When electrical pump 154 is activated, it automatically pumps fluid through a second poppet valve 164 and into lifts 24, thereby raising frame 26 upward. A check valve 166 keeps hydraulic fluid from back flowing during the operation of either, or both, of lifting pedal 38 and electrical pump 154. Further, if fluid is automatically pumped by electrical pump 154, first poppet valve 162 will prevent the resulting increase in pressure in the fluid from pushing pedal 38 upward. First poppet valve 162 thus isolates the electric pump 154 from pedal 38. If electrical power is not available for electrical pump 154, second poppet valve 164 prevents the hydraulic fluid from back flowing through pump 154, thereby enabling manual pumping to still be accomplished through the reciprocation of pedal 38. It will be understood by those skilled in the art that other types of one-way valves may be used in addition to, or in lieu of, the poppet and check valves described herein. Still further, other types of circuit arrangements may be constructed that substantially isolate manual pump 160 from the increased hydraulic pressure caused by the activation of electric pump 154.

Figure 12:
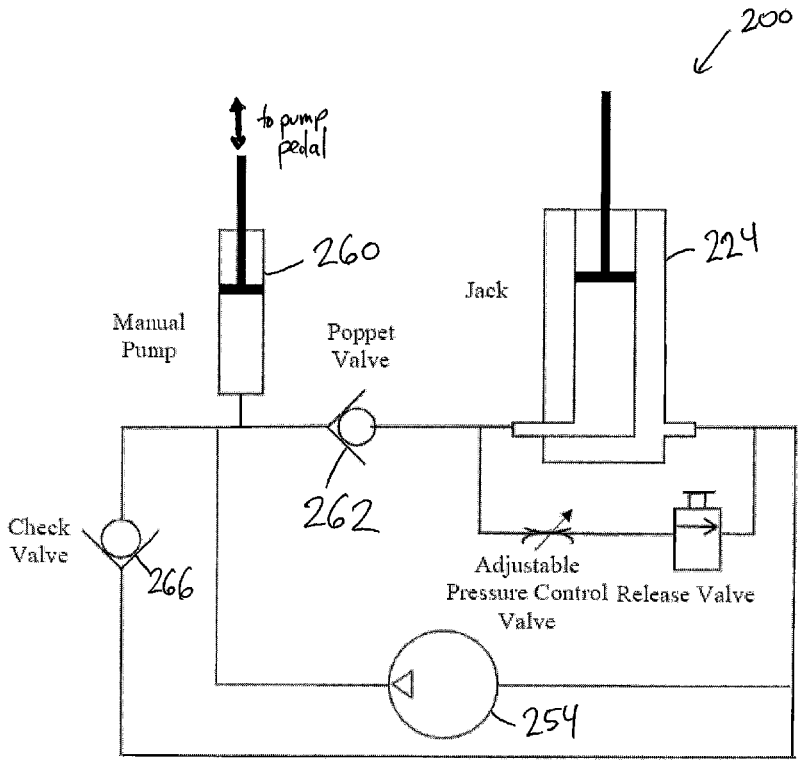
FIG. 12 PRIOR ART
FIG. 12 is a diagram of a prior art hydraulic circuit used to control the hydraulic lifting of a frame and deck of a stretcher relative to its base.

FIG. 12 illustrates a prior art hydraulic circuit 200 that has been used in combination with a switch that does not get activated until the bottom of the downstroke of a pedal, such as a pedal similar to pedal 38. When the pedal reaches the bottom of the downstroke, the switch (not shown) is activated, which, in turn, activates a motor 254. Motor 254 pumps hydraulic fluid through a poppet valve 262 where the fluid then raises jack 224. A check valve 266 prevents the fluid pumped by motor 254 from back flowing during operation of motor 254. An adjustable pressure control valve and release valve allow the pressure inside the jack 224 to be controlled and/or the fluid therein to be released.

The prior art hydraulic circuit 200 is not suitable for use with a switch that is activated near the top of the corresponding pedal's stroke. This is because, upon activation of motor 254, the pumped fluid will, in addition to being pumped into jack 224, be pumped into manual pump 260. This has the tendency to push the user's foot, positioned on the corresponding pedal (such as pedal 38) upward. If the switch is activated near the top of the pedal's stroke, this pushing of the user's foot very well may push the user's foot sufficiently far upward that the corresponding switch becomes deactivated. Upon deactivation of the switch, motor 254 is also deactivated, thereby leading to a pressure drop in manual pump 260. This drop in pressure inside manual pump 260 will allow the user's foot (which is still likely pushing down on manual pump) to move downward sufficiently far to re-activate the corresponding switch, thereby leading to the same sequence of events just described, which will result in an undesirable oscillatory motion of the pedal, manual pump 260, and jack 224. This undesirable condition is avoided by the new hydraulic circuit of FIG. 11, which isolates the fluid pumped by motor 154 from the manual pump 160, thereby leaving manual pump 160 largely unaffected by the activation of motor 160.

It will be understood by those skilled in the art that the various features of patient handling device 20 described herein may be combined together and separated apart in different manners from what has been shown and described herein. For example, the design of handle assembly 84, the design of pump pedal 38, the use of gas strut 116, and the staggering of control panels 58 and 60 may all be incorporated into a single patient device 20, such as has been described herein, or individual ones of these features, or selected subcombinations of these features, may be incorporated into a patient handling device. Thus, as but one example, a patient handling device having staggered control panels may be incorporated into a patient handling device that does not include the handles assembly 84 described herein, nor the lifting pedals 38. Multiple other combinations and subcombinations are also possible.

It will further be understood that the embodiments shown in the drawings and described above are merely for illustrative purposes, and are not intended to limit the scope of the invention which is defined by the claims which follow as interpreted under the principles of patent law including the doctrine of equivalents.

What is claimed is:

1. A patient handling device comprising:

a base having a plurality of wheels adapted to allow said patient handling device to be moved to different locations;

a frame supported on said base;

a plurality of lifts positioned between said frame and said base, said lifts adapted to raise and lower said frame relative to said base;

a deck supported by said frame, said deck adapted to support a patient, said deck including an upper section positioned to support a patient's torso and a seat section positioned adjacent to said upper section, said upper section pivotable about a horizontal pivot axis between a horizontal orientation and a raised orientation;

a pedal coupled to said base, said pedal movable between a raised position and a lowered position, said pedal adapted to activate an electric switch after said pedal has been moved out of said raised position but prior to said pedal reaching said lowered position, said electric switch activating said plurality of lifts to raise said frame;

an electric pump coupled to said electric switch, said electric pump adapted to pump hydraulic fluid to said lifts when said electric switch is activated; and a manual hydraulic pump coupled to said pedal, said manual pump adapted to pump hydraulic fluid to said lifts in response to downward movement of said pedal.

2. The device of claim 1 further including:

an electric actuator adapted to pivot said upper section about said horizontal pivot axis, a first siderail positioned along a first side of said deck;

a second siderail positioned along a second side of said deck;

a first control panel supported on said first siderail; and a second control panel supported on said second siderail, wherein said first and second control panels include controls for activating said electric actuator to automatically pivot said upper section about said horizontal pivot axis.

3. The device of claim 1 wherein said manual hydraulic pump is sufficiently fluidly isolated from said electric pump such that increased pressure in the hydraulic fluid caused by the electric pump does not increase a pressure inside the manual hydraulic pump.

4. The device of claim 3 wherein said patient handling device is a stretcher.

5. The device of claim 4 further including:

an electric actuator adapted to pivot said upper section about said horizontal pivot axis, said electric actuator adapted to assume a first state in which rotation of said upper section about said pivot axis is permitted to occur electrically, and a second state in which rotation of said upper section about said pivot axis is permitted to occur manually;

a biasing member adapted to urge said upper section toward the raised position; and a control adapted to switch said electric actuator between said first and second states, wherein when said electric actuator is in said second state, said biasing member prevents said upper section from free-falling toward said horizontal orientation.

6. The device of claim 5 wherein said biasing member includes a gas strut.

7. The device of claim 6 wherein said control includes a handle positioned adjacent a corner of said upper section of said deck, and a cable operatively coupled to said handle and said electric actuator, wherein squeezing of said handle causes said electric actuator to switch from said first state to said second state.

8. The device of claim 6 wherein said control includes a first handle positioned adjacent a first corner of said upper section of said deck, a second handle positioned adjacent a second corner of said upper section of said deck, and a cable operatively coupled to both said first and second handles and said electric actuator, wherein squeezing of either or both of said first and second handles causes said electric actuator to switch from said first state to said second state.

9. The device of claim 1 further including:

an electric actuator adapted to pivot said upper section about said horizontal pivot axis, said electric actuator adapted to assume a first state in which rotation of said upper section about said pivot axis is permitted to occur electrically, and a second state in which rotation of said upper section about said pivot axis is permitted to occur manually;

a biasing member adapted to urge said upper section toward the raised position; and a control adapted to switch said electric actuator between said first and second states, wherein when said electric actuator is in said second state, said biasing member prevents said upper section from free-falling toward said horizontal orientation.

10. The device of claim 9 wherein said biasing member includes a gas strut.

11. The device of claim 9 wherein said control includes a handle positioned adjacent a corner of said upper section of said deck, and a cable operatively coupled to said handle and said electric actuator, wherein squeezing of said handle causes said electric actuator to switch from said first state to said second state.

12. The device of claim 9 wherein said control includes a first handle positioned adjacent a first corner of said upper section of said deck, a second handle positioned adjacent a second corner of said upper section of said deck, and a cable operatively coupled to both said first and second handles and said electric actuator, wherein squeezing of either or both of said first and second handles causes said electric actuator to switch from said first state to said second state.

13. The device of claim 12 wherein said first and second handles are coupled to said cable in such a manner that squeezing of said first handle does not cause said second handle to be squeezed, and squeezing of said second handle does not cause said first handle to be squeezed.

14. The device of claim 1 wherein said patient handling device is a stretcher.

* * * * *